United States Patent [19]

D'Alto

[11] Patent Number: 5,000,403

[45] Date of Patent: Mar. 19, 1991

[54] BRIDLE AND CONTROL DEVICE FOR FLEXIBLE KITE

[76] Inventor: Nicholas D'Alto, 2462 Marie Ct, Bellmore, N.Y. 11710

[21] Appl. No.: 443,701

[22] Filed: Nov. 30, 1989

[51] Int. Cl.[5] ..... B64C 31/06

[52] U.S. Cl. ..... 244/155 A

[58] Field of Search ..... 244/153 R-155 A; D21/87-90, 84; 446/30-34

[56] References Cited

U.S. PATENT DOCUMENTS

| | | | |
|---|---|---|---|
| 744,529 | 1/1930 | De Haven | 244/153 R |
| 2,388,478 | 11/1945 | Garber | 244/155 A |
| 3,421,722 | 1/1969 | May et al. | 244/155 A |
| 4,457,478 | 7/1984 | Christoffel, Jr. et al. | 244/155 A |

OTHER PUBLICATIONS

*Kites,* David Pelham, p. 135, 1976 ©.

*Primary Examiner*—Galen Barefoot

[57] ABSTRACT

The invention is a control device for a flexible kite. A flexible kite, is a kite in which the lifting surfaces are free to orient themselves, with respect to each other, in response to the wind. The invention consists of mechanisms which allow the operator to actively control the orientations of the kite's lifting surfaces, with respect to each other, for the purposes of maintaining equilibrium during flight, accommodating various wind conditions, and performing various airborne maneuvers.

7 Claims, 3 Drawing Sheets

BRIDLE AND CONTROL DEVICE FOR FLEXIBLE KITE

BACKGROUND OF THE INVENTION

The invention relates to the construction of kite bridles, which assist in orienting and maintaining the lifting surfaces of flexible kites, and which permit the alteration of these surfaces, for the purposes of aerodynamic flight control.

DESCRIPTION OF THE PRIOR ART

The invention relates to governing the motion and attitude of an airborne, flexible kite, for the purposes of maintaining equilibrium, and for the execution of various airborne maneuvers.

A flexible kite, comprises all those species of kite, in which portions of the framework, or in the absence of a framework, the anchoring perimeters of the body of the kite, are capable of motion with respect to each other. The object of this motion is generally to allow the force of the wind to shape the lifting surfaces, and for variations in the force of the wind upon the surfaces, to alter the orientations of the surfaces, so as to maintain equilibrium.

The most generally accepted method to construct a dirigible kite, is to fix upon various points of the kite, a series of bridles, each of which conducts a flying line directly down to the operator. U.S. Pat. No. 4,736,914 is an example of this art. By variuosly extending or withdrawing these flying lines along their length, the operator causes the kite's lifting surface to tilt about an axis. The resulting oblique attitude of the kite towards the wind, causes the kite to be deflected in the desired direction.

A disadvantage of this method, is that the flying lines, spaced to the left and the right of the kite's longitudinal axis, merely transmit an externally applied torque from the control lines, to the surface of the kite, without materially affecting the geometry of the kite. This method might be likened to the use of a shifting weight to control a freely flying object.

Devices which physically move the bridle point with respect to the kite, for instance as U.S. Pat. No. 4,280,675, likewise establish a control response by establishing a moment arm between the force from the undeformed kite surface, and force in the flying lines.

The overwhelming majority of flying objects exercise control by changing the shape and orientation of their lifting surfaces. As such, devices which apply a wholesale torque, upon undeformed surfaces, cannot instruct an operator in many important aspects of flight control.

A further disadvantage of these systems, is that the designer must often construct a costly, rigid, framework, sufficiently rigid to avoid loss of shape during flight, and sufficiently robust to avoid damage, in the event that the stiffly joined framework strikes the ground.

These methods also prevent the kite designer from seriously investigating the inherent stability of his craft. A consequence of maintaining a kite by using several flying lines, each distant from the aggregate center of pressure of the lifting surfaces, and each conducted from separate points, directly to the ground, is that many configurations of kite, which are themselves seriously unstable when restrained only along their thrust line, will be made to fly, in spite of this inadequecy.

The attitude and path of an airborne kite has also been controlled by deflecting the incident airstream using vertical rudders, like ships' rudders. This method does not demonstrate the method of control exercised by the majority of flying objects found in nature, or elsewhere, where vertical rudders, when used, provide restorative balance during turning, rather initiating turning, as would happen in a ship.

Kites have been controlled in the air by actuating various types of airplane control surfaces, including ailerons and wing warping devices. The subject invention falls within this category. These methods have heretofore suffered from the need for numerous control lines, or a complicated mechanism in the body of the kite, or from an arrangement that does not preclude the application of wholesale torques upon the undeformed surfaces of the kite, or by generally encumbering the inherent stabilizing properties of the kite, owing to the fixity confered by widely spaced control lines, or likewise concealing flawed stability in the kite's pattern, owing to the presense of control lines taking widely spaced paths to the operator.

The present invention obviates these difficulties. It provides a mechanism that materially strengthens the kite during flight. It is simple to construct, and very durable.

SUMMARY OF THE INVENTION

The invention consists of a device, suitable to function as a kite bridle, and through which the attitude, and path, of an airborne kite may be altered, by manipulating flying lines that alter the inclination of portions of the kite's lifting surfaces. The bridle is so arranged as to conduct all of the flying lines along the thrust line of the kite. Portions of the bridle are adjustable with respect to each other. The bridle may thus be trimmed, so as to accommodate various wind conditions, and to cause the force of the wind upon the kite, to automatically lend rigidity, or allow flexure, to various portions of the kite. Manipulations of the flying lines actuates the moveable portions of the bridle, in such ways to cause, or allow, the lifting surfaces of the kite to be inclined, for the purpose of exercising aerodynamic control.

It is therefore an objective of this invention, to provide a mechanism for the control of an airborne kite, in which the control lines are collectively conducted along a common path, which is the path that a line takes, when the kite is flown from a single line.

Another objective of this invention, is to provide a mechanism which lends rigidity to a flexible kite during its flight, and assists in maintaining its elements in their desired arrangement.

Yet another objective of this invention, is to provide a mechanism that lends rigity to an airborne kite, by such means that said rigidity is instantly cancellable by the operator, for the purposes of exploiting the elasticity of the kite, in the event of landing, or striking the ground.

Still another objective of this invention, is to provide a mechanism which controls an airborne kite, by inclining portions of its lifting surface.

Another objective of this invention, is to provide a mechanism to control an airborne kite, which simultaneuosly allows the surfaces of the kite to automatically reorient themselves in reponse to the wind, so as to stabilize the kite.

Another objective of this invention, is to provide a control mechanism that may be simply attached to a variety of commonly available kites.

Yet another object of this invention, is to provide a mechanism for controlling an airborne kite, which may be swiftly converted into a bridle for a single line, non-dirigible kite.

Still other objects of this invention, are to provde a control mechanism for an airborne kite, which is inexpensive and simple to construct, easy to operate and durable.

Yet another objective of this invention, is to provide a control mechanism, which uses the force of the wind to assist the operator in actuating the controls.

Yet other objectives of this invention, are to provide a mechanism to control an airborne kite, such that for a particular set of wind conditions, the force in the flying lines may be reduced to assist the operator, and the kite may be made to reach its maximum height for a given extension of flying lines.

Still other objectives of this invention, are to provide a control mechanism, which assists a kite in flying in a minimum of wind, and allows the kite to remain controllable, at extreme altitudes.

DESCRIPTION OF THE PREFERRED EMBODIMENT

The invention consists of a governable bridle, for controlling a flexible kite. One such species of kite, consists of a framework, employing a central spine, oblique arms to either side of the spine, a spreading bar, perpendicular to the spine, and flexibly attached to the arms, likewise spreading bars joining the arms with the spine towards the rear of the arms, and a wing membrane of isosceles triangular planform, attached along its sides to the arms, and along its perpendicular bisector, to the spine.

The invention provides specific mechanisms for causing alterations in the left and right portions of the lifting surfaces of a flexible kite, sufficient to change the path of the kite through the air.

Figure 1:
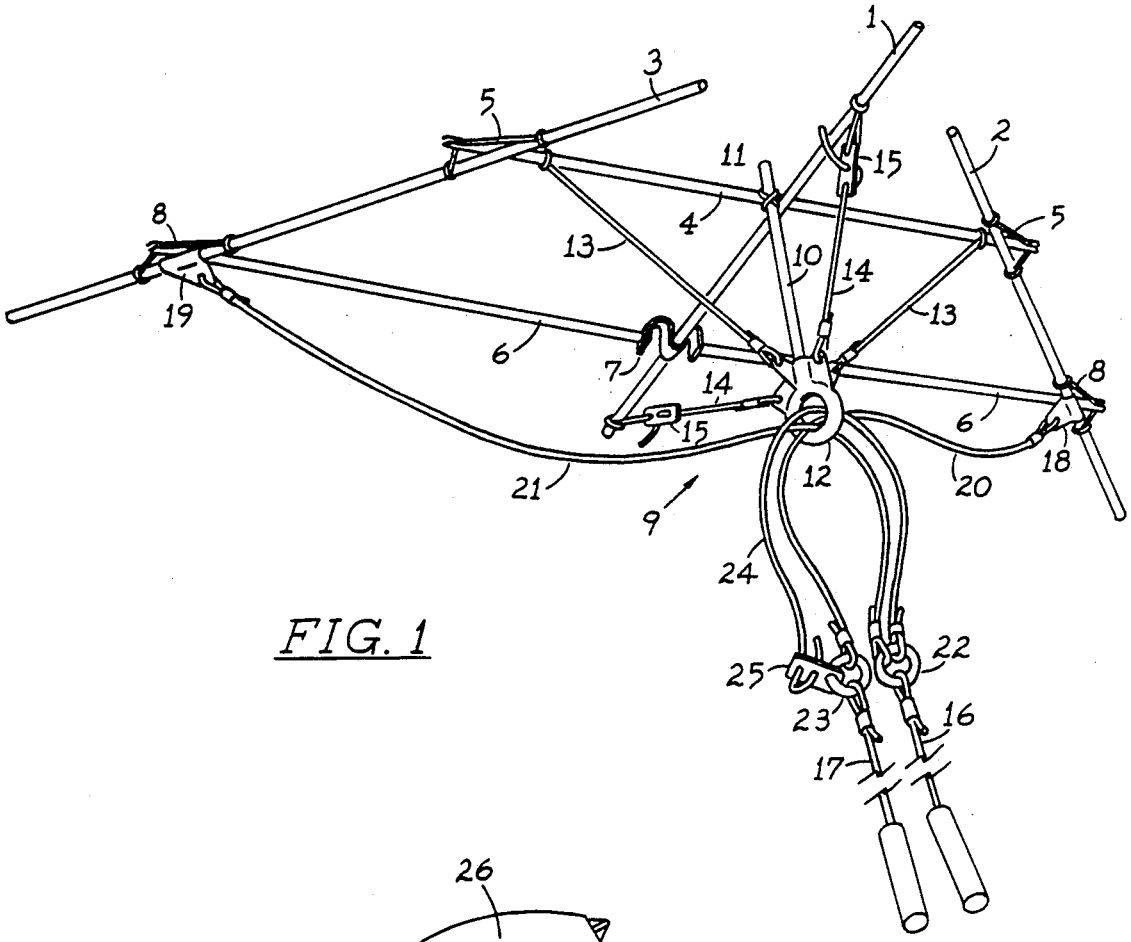
FIG. 1 is a perspective view, showing the framing of a conventional, flexible kite, and having the subject invention affixed to it, and showing several of the flexible members of said invention, spread from their operating positions, for the purposes of clarity.

Refering more specifically to the diagrams, FIG. 1 shows the framework of a conventional, flexible kite, comprised of a spine, 1, two oblique arms, 2, and 3, a spreading bar, 4, which is flexibly connected to the arms by the joints, 5, and two trialing edge bars, 6, each flexibly connected to the spine, by the joints, 7, and flexibly connected to the arms, 2, and 3, by the joints, 8.

Upon this framework is affixed a governable bridle, collectively called 9. This bridle is comprised of a kingpost, 10, which stands nominally orthogonal to the plane of the framework of the kite, and is attached to the spreading bar, 4, by the joint, 11. The kingpost, 10, carries upon its extended end, a ring, 12. The kingpost is stayed in position, relative to the frame of the kite, by lateral guying members, 13, attached to the ring, 12, by any convenient means, and proceeding rightly and leftly, and being attached to the spreading bar, 4, as close to its ends as practicable. The kingpost is likewise stayed in position by spine cords, 14, which extend backwardly and forwardly to adjustable closures, 15, which are carried upon the extremities of the spine, 1, such that the spinecords may be drawn through said closures, allowing the angle between the kingpost and the spine to be varied and fixed, at pleasure.

By these methods, the ring, 12, is rendered immobile with respect to the framework of the kite, and fixed to the appropriate position to serve as an anchor point for the flying lines, 16, and 17.

From two control mounts, 18, and 19, situated on the arms, 2, and, 3, and equidistantly behind the joints, 5, extend the control cords, 20, and 21, such that the control cords pass entirely through the opening formed within the ring, 12, and cross within this opening, and terminate, a distance from the ring, in anchoring lugs, 22, and 23. These lugs are interconnected by a communicating cord, 24, which proceeds from the lug, 22, passes through the openning formed by the ring, 12, and terminates in an adjustable closure, 25, affixed to the lug, 23. This permits the length of communicating cord between the lugs to be varied, and fixed at pleasure.

From the lugs, 22, and 23, suitable flying lines, 16, and 17, may be attached for the purposes of sending the kite into the air.

Figure 2:
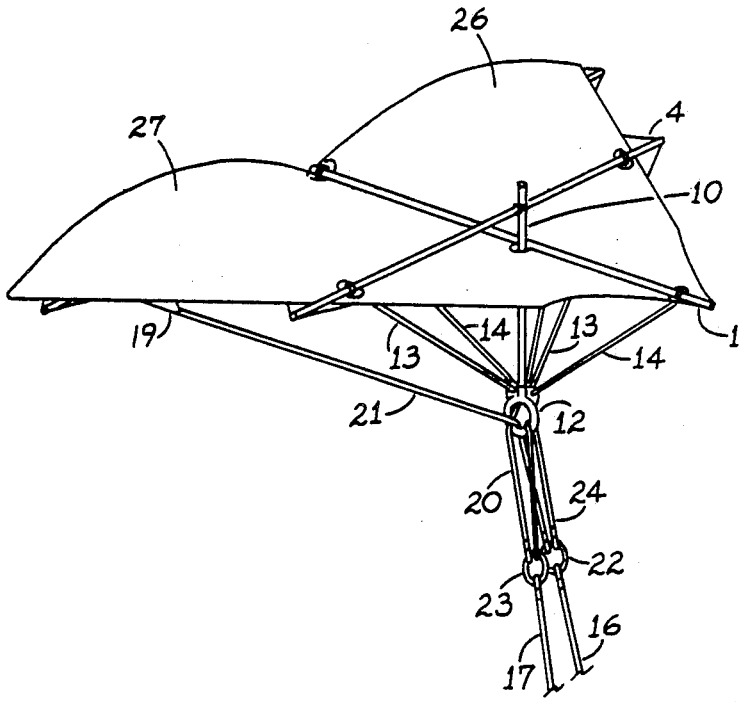
FIG. 2 is a perspective view showing a conventional flexible kite, in an attitude of flight, and having the subject invention affixed to it.

FIG. 2 shows the kite, in an attitude of flight. It is apparent that, when the force of the wind acts upon the membrane wings, 26, and 27, during flight, it is resisted by tension in the communicating cord, and tension in the control cords.

Figure 3:
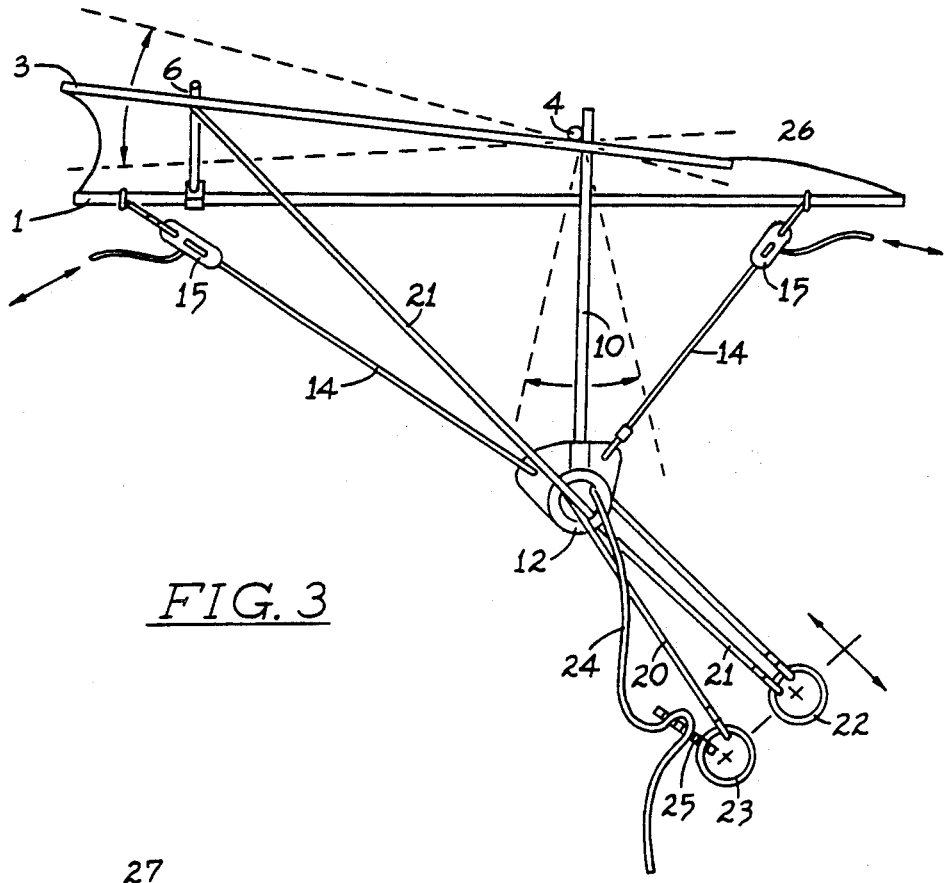
FIG. 3 is a side view of a conventional flexible kite, showing the subject invention affixed to it, and illustrating the trimming of the members of the subject invention, prior to flight, to accommodate various conditions of the wind.

FIG. 3 illustrates that prior to flight, the attitude of the kite's arms, 2, and 3, with respect to the spine, 1 may be set by adjusting the closure 25, so as to increase or decrease the length of communicating cord between the lugs, 22, and 23. This allows the nominal angle of attack of the wings, 26, and 27, to be set, and the nominal lateral dihedral angle between the wings, to be set for a variety of wind conditions. The angles of attack of the wings will be equal, when the lugs, 22, and 23, are equidistant from the ring, 12.

It is likewise shown in FIG. 3., that the adjustment of the closures, 15, prior to flight, permits the ring, 12, to be so located as to balance the kite, fore and aft., during its flight.

Figure 4:
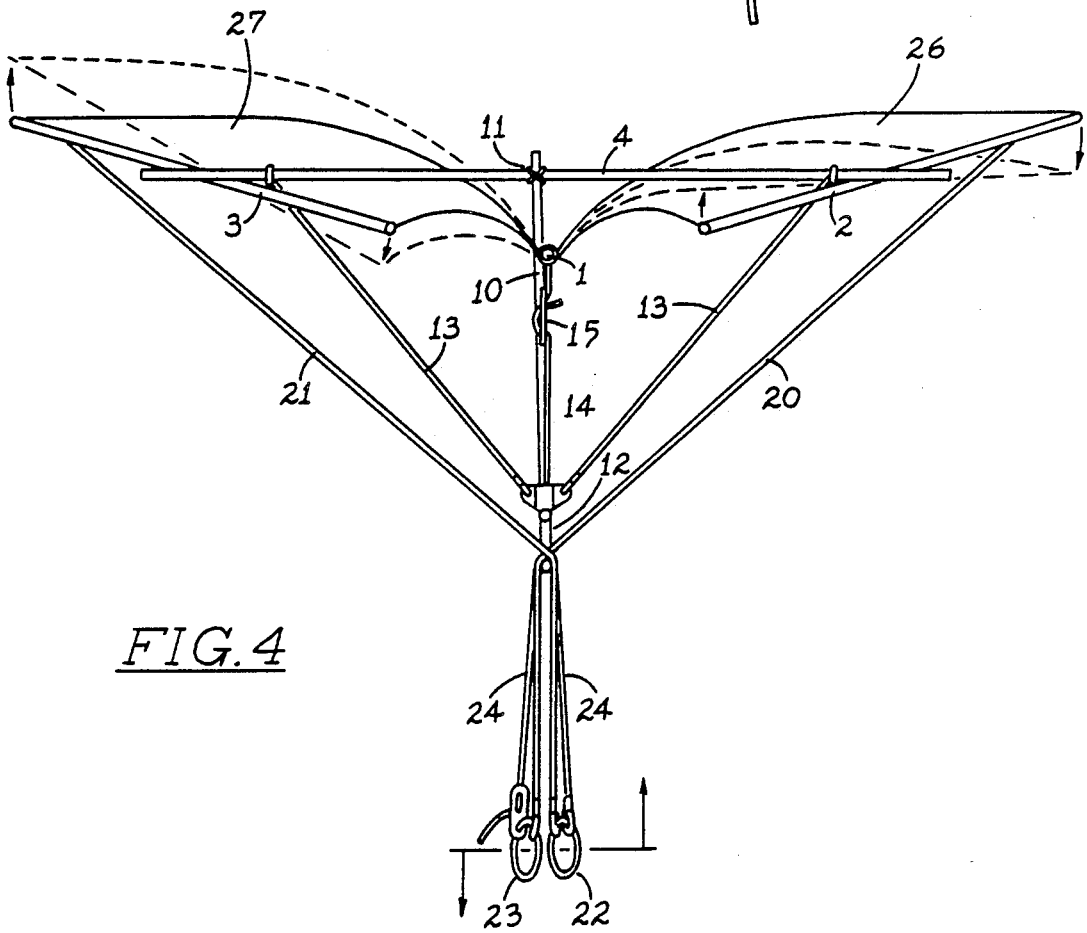
FIG. 4 is a frontal view of a conventional flexible kite, showing the subject invention affixed to it, and showing a typical actuation of said device, for the purposes of controlling the kite's path through the air.

FIG. 4 shows a frontal view of a typical kite, with the subject invention affixed to it, and showing a typical control input. When the flying line, 16, is drawn downward, the control cord, 20, is drawn an equal amount, along its length. The drawing of the cord, 20, depresses the arm, 2, and confers upon the connected wing, 26, a steeper angle of attack. It is likewise obvious that the lug, 22, when drawn down by this movement, draws the lug, 23, towards the ring, 12, by the action of the communicating cord, 24. Since the control cord, 21, is then simultaneously payed out, and the arm, 3, experiences an upward force during flight, associated with restraining the attached wing, 27, this wing rises, owing to atmospheric action, to assume a shallower angle of attack.

The resulting differential in attack angle upon the left and right wings, may be judiciously applied to yield various changes in the attitude, and path, of the kite. Among these are rolling changes of attitude, turning actions to left and right, as well as horizontal sweeping, looping, and diving actions.

It is immediately apparent that since the members of the device are carried from the device, at a point that is directly beneath the central spine of the kite, that no manipulation of the flying lines can turn the undeformed body of the kite, as would occur if the control lines conducted from points to the left and right of the kite's center. In this way, changes in the motion of the kite are initiated by alterations in the lifting surfaces, similiar to those which occur in birds, aircraft, and other flying objects.

It is further obvious, that while the invention confers fixity to the framework of the kite, in response to flight induced tensioning, and at any desired angle of attack, that the arrangement continues to allow a range of flexibility within the framework, as may be desired to allow for vagaries in the force and direction of the wind, by the provision that the length of the communicating cord, 24, between the lugs, 22, and 23, may be shortened to such extent, that a particular strength of wind does not raise the arms of the kite so high, as to completely tighten the control cords. By this means, the automatic alteration of the lifting surfaces, for the purposes of restoring equilibrium, a quality inherent in many designs of flexible kite, may work simultaneously with active control by the operator.

It is apparent that, if it is desired to have one wing at a steeper angle of attack than the other, there are three distinct manipulations, which the operator can perform. If the operator draws one flying line downward, while maintaining the other flying line, the one wing is inclined, the other declined by atmospheric action, and the kite is drawn slightly downward, along the path of the flying lines, by virtue of the ring being drawn down the communicating cord. Being thus drawn downward, the kite receives a relative velocity of the wind in an upward direction, and this assists the kite in maintaining its altitude, during the maneuver.

If the operator draws one flying line downward, while simultaineuosly relaxing the other flying line upward, the surfaces of the kite take the same deformations as previously, but in this case, the kite neither rises or falls, relative to the communicating cord.

If the operator maintains one control line, and relaxes the other, the deformation of the kite's surfaces is the same, but the body of the kite is blown backwards along the direction of its flying lines. It is apparent that the force of the wind upon the kite not only shallows the one wing's angle of attack, but also steepens the opposite wing's position, owing to the communicating cord running through the ring, as the kite is blown backward. Thus the force of the wind materially assists in the actuation of the control surfaces.

It is apparent that the communicating cord, by preventing both of the control lines from being drawn downward together, and by bearing a portion of the force which restrains the kite, allows the same lines which anchor the kite, to control the kite, as opposed to requiring separate sets of lines.

Figure 5:
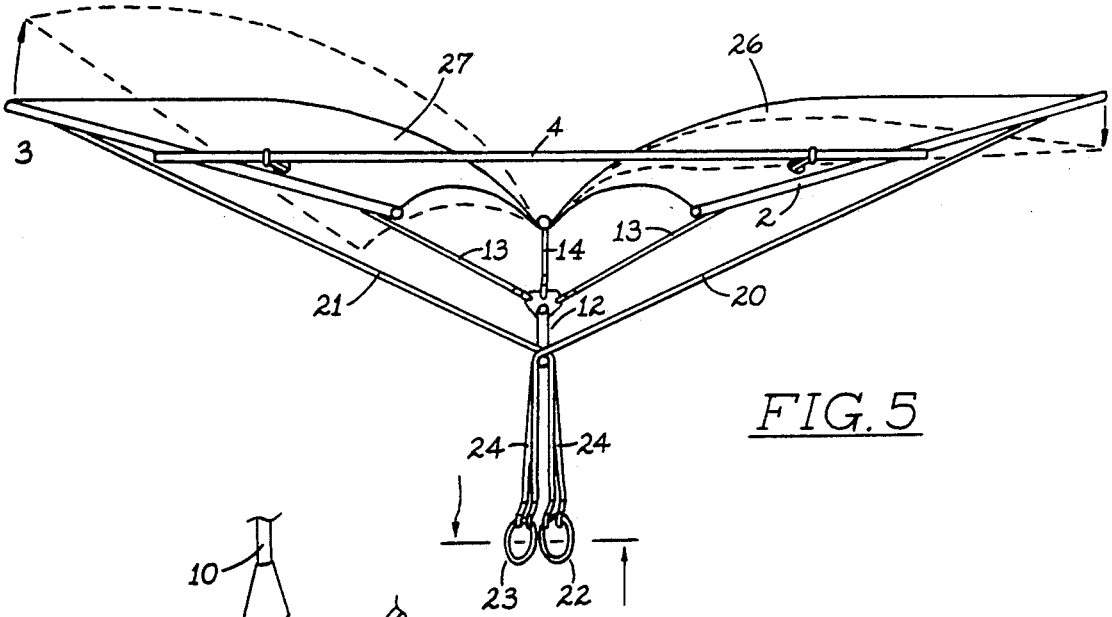
FIG. 5 is a frontal view, substantially as FIG. 4, but illustrating a special and noteworthy case in the construction and attachment of said invention.

FIG. 5 shows a special and noteworthy case of the invention. It has been found that when the invention is attached to such kites as will allow the angle included between the control cords, 20, and 21, to exceed the angle taken by either control cord, as they pass through the ring, 12, that the resultant forces on the ring, 12, which would tend to move it, with respect to the kite, may be resisted solely by the flight-induced tensioning of the guys, 13, and the spine cords, 14, allowing the kingpost, 10, to be omitted.

Figure 6:
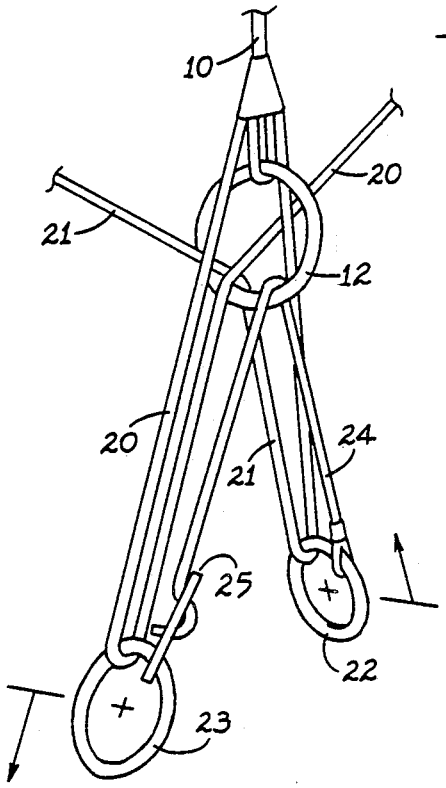
FIG. 6 is a view of a portion of the invention, showing several of its members arranged in a special and noteworthy construction.

FIG. 6 plainly illustrates that the travel in the control cords, 20, and 21, can be conveniently doubled with respect to the travel of the flying lines, 16, and 17, this being accomplished by relocating, prior to flight, the terminations of the control cords from the lugs, 22, and 23, to a point above the ring, 12, by such method that the control cords each pass entirely through the openings formed by their respective lugs, and such that the lugs may slide upon the communicating cords. This configuration is especially useful in the event that a small motion by the operator, is desired to make a large change in the geometry of the kite. It is likewise useful in the event that the kite is to be flown at extreme altitude, since the associated weight, bowing, and stretch in long flying lines reduces the actual travel of one of its ends, with respect to the other, and might otherwise demand an operator movement beyond the length that the operator can span.

An important element of this invention, is its ability to confer rigidity to the body of a kite, conditional to the tension in the flying lines. This allows the use of simple, and inexpensive, flexible kites, as dirigible kites. A further advantage of this effect is that the kite may be rendered flexible, even against a strong breeze, by relaxing the tension in the flying lines. This may be used to escape damage in the event that the kite strikes the ground. Simply extending the flying lines will allow the kite to exploit its flexibility in withstanding disarrangements of its frame.

A further advantage of this invention, is that it uses the force of the wind to assist the operator in actuating the controls, as a means to reduce the necessary machinery. Heretofore, duplicate sets of machinery have been necessary, to both increase, and decrease, the attack angles of various portions of a kite's lifting surface.

The device, as described, is likewise automatically self locking, to any desired wing positions of the kite, by the operator merely holding the terminations of the flying lines in the appropriate positons.

A further advantage of this system, is that by trimming the invention, prior to flight, and thereby setting the kite's nominal angle of attack, and lateral dihedral, the range of tension in the flying lines may be altered, either to maintain adequate tension in the flying lines in light winds, or to prevent strain on the operator, or breakage of the flying lines, or the need for heavy flying lines, when facing strong wind.

A further advantage of this invention, is that it may be swiftly converted in a bridle suitable for the attachment of a single flying line, which may be attached to both of the lugs, 22, and 23, and which permits the kite to be flown as a single line, non dirigible kite, without loss of stability.

It is to be understood that the invention as described, is illustrated with, and referred to in connection with, a particular species of flexible kite, for the purposes of facilitating the explanation of its features and operation. It is the intention of the inventor, that the invention may be applied to a wide variety of flexible, or otherwise jointed kites. For instance, while it has been found convenient to employ triangular planform kites, carrying hinged trailing bars near the rear of the kite's spine in practice, kites of other configurations may be used. It is likewise the intention of the inventor that the specific number of a particular element of the invention, and the locations of the attachment points between the invention and the kite, will by needs vary with the configuration of kite employed. It is likewise obvious that the various members of the invention may be combined by the artisan, according to convenience. For instance, a triangular keel attached along the kite's spine, can serve the equivalent function of the spine cords, or a plurality of rings, any one of which the members of the invention may be made to pass through, may be used in place of a single, adjustable ring. It is likewise obvious that the various alternate constructions of the invention may be combined at pleasure, for instance, the use of sliding lugs, with, or without, a kingpost.

What is claimed as new and desired to be secured by Letters Patent of the United States is:

1. A control device for a flexible kite, comprising a ring, and comprising members to suitably stay said ring beneath the lateral center of a kite, such that said staying performs the function of a bridle, and said ring having communicated upwards through the opening that it forms, control lines of the device extending to the kite's flexible extremities, such that these control lines may be actuated by the operator, using flexible lines which conduct along a common path along the lateral center of the kite, to oppositely alter the angles of attack of the kite's supporting surfaces at the left and the right of the kite's lateral center, for the purposes of exercising aerodynamic control over said kite, and such that the control lines are mutually linked from points beneath the ring by an element of the device, which passes through the ring, such that equivalent tension upon the control lines prevents their motion.

2. The invention, substantially as described in claim 1, and capable of adjustment with respect to said members, so as to admit a range of inherently stabilizing movements within the body of the flexible kite to which it is attached, while simultaneously providing the opportunity for active control over the attitude and path of the kite, by the operator.

3. The invention, substantially as described in claim 1, and means for adjusting said members to be capable of performing adjustments on the nominal angles of attack, and range of angles of attack, and the nominal lateral dihedral angle between, the lifting surfaces to the left and the right of a flexible kite, so as to accomodate a wide range of flying conditions.

4. The invention, substantially as described in claim 1, and capable of adjustment to said members, so as to vary the longitudinal location of the ring, prior to flight.

5. The invention, substantially as described in claim 1, and so arranged as to allow restraining and controlling forces that the invention exerts upon the lifting surfaces of the kite to which it is affixed, to be swiftly cancellable, in order to escape the breakage of the kite, in the event that it strikes the ground.

6. The invention, substantially as described in claim 1, and so arranged as to permit the force of the wind upon the kite, to assist the operator in actuating the invention.

7. The invention, substantialy described in claim 1, and capable of swift conversion into a kite bridle suitable for attaching a single flying line, for the purposes of flying a kite in non-dirigible fashion.

* * * * *